US005503726A

United States Patent [19]

Hamada et al.

[11] Patent Number: 5,503,726

[45] Date of Patent: Apr. 2, 1996

[54] PLATING APPARATUS

[75] Inventors: Kunihiko Hamada, Takefu; Shigehiro Nojiri, Fukui; Kazuma Tanaka, Takefu; Tatsuya Todo, Fukui, all of Japan

[73] Assignee: Murata Manufacturing Co., Ltd., Nagaokakyo, Japan

[21] Appl. No.: 490,143

[22] Filed: Jun. 14, 1995

[30] Foreign Application Priority Data

Jun. 15, 1994 [JP] Japan ..... 6-133220

[51] Int. Cl.[6] ..... C25D 17/16

[52] U.S. Cl. ..... 204/222; 204/273

[58] Field of Search ..... 204/22, 273; 205/145

[56] References Cited

U.S. PATENT DOCUMENTS

| | | | |
|---|---|---|---|
| 2,177,877 | 10/1939 | Pfaffmann | 204/222 |
| 2,721,834 | 10/1955 | Koury | 204/222 X |
| 3,275,542 | 9/1966 | Couture | 204/222 |
| 3,397,126 | 8/1968 | Gilbert | 205/145 |
| 4,253,916 | 3/1981 | Kobayashi et al. | 204/145 |
| 5,124,016 | 6/1992 | Barbier | 204/222 |

FOREIGN PATENT DOCUMENTS

| | | |
|---|---|---|
| 77026490B | 7/1977 | Japan . |
| 59043894 | 3/1984 | Japan . |
| 61-14237 | 4/1986 | Japan . |
| 2025590 | 1/1990 | Japan . |
| 4186664 | 7/1992 | Japan . |

*Primary Examiner*—Donald R. Valentine
*Attorney, Agent, or Firm*—Burns, Doane, Swecker & Mathis

[57] ABSTRACT

A plating apparatus (11) includes a plating solution container (13) storing a plating solution (14) and a cathode (18) dipped therein, for plating objects which are placed on the cathode (18) by driving an air cylinder (22) for applying vibration to the cathode (18) while making a stopper (24) collide with a forward end (21*a*) of a coupling member (21) which is coupled to the air cylinder (22) and the cathode (18) thereby applying an impact to the cathode (18).

7 Claims, 2 Drawing Sheets

PLATING APPARATUS

BACKGROUND OF THE INVENTION

1. Field of the Invention

The present invention relates to a plating apparatus for wet-plating objects, and more particularly, it relates to a plating apparatus having improved means for moving objects to be plated.

The present invention can be employed for plating various objects such as chip-type electronic components, for example.

2. Description of the Background Art

In general, a barrel plating apparatus is known as a plating apparatus for forming plating layers on external electrodes which are provided on chip-type electronic components. In the barrel plating apparatus, a plating solution, conductive media such as steel balls and objects to be plated are introduced into a cylindrical barrel, which in turn is rotated for electroplating the objects.

When such a barrel plating apparatus is employed, however, the media are also plated, to result in the following problems: (1) A relatively long time is required for plating the objects, (2) it is necessary to mix/separate the media and the objects with/from each other, and (3) the cost is relatively increased due to requirement for a large number of media.

In order to solve these problems of the barrel plating apparatus, Japanese Patent Publication No. 61-14237 (1986) proposes an apparatus for plating chip-type electronic components by placing the same on a cathode consisting of a metal mesh member. The plating apparatus described in this gazette is now described with reference to FIG. 1.

This plating apparatus 1 has a plating solution container 3 storing a plating solution 2. A cathode 4 is dipped in the plating solution 2. The cathode 4, which is formed by a metal mesh member, is suspended by suspenders 5 and 6, to be dipped in the plating solution 2. Further, an anode 7 is also dipped in the plating solution 2, so that a voltage is applied across the anode 7 and the cathode 4 for performing electroplating.

In addition, a vibrating part 8*a* of an ultrasonic vibrator 8 is dipped in the plating solution 2, for vibrating the plating solution 2 as well as the cathode 4. Namely, the cathode 4 which is simply suspended by the suspenders 5 and 6 is vibrated by the vibration applied from the ultrasonic vibrator 8. Consequently, chip-type electronic components 9 which are placed on the cathode 4 are slid on this cathode 4. The chip-type electronic components 9 are moved on the cathode 4 for changing contact portions between parts of the chip-type electronic components 9 requiring plating and the cathode 4, thereby reliably forming plating layers on the parts requiring plating.

The aforementioned gazette also discloses a structure of vibrating the cathode 4 by another vibrator which can apply physical vibration in place of the ultrasonic vibrator 8, thereby moving the chip-type electronic components 9 on the cathode 4.

The plating apparatus 1 disclosed in the aforementioned prior art is adapted to apply microvibration for sliding the chip-type electronic components 9, which are objects of plating, on the cathode electrode 4, thereby plating the same. However, when the plating is carried out at a high speed for forming plating layers of 3 μm in thickness in about 5 minutes, for example, the chip-type electronic components 9 may disadvantageously adhere to each other or to the cathode 4 through plating films.

When the applied vibration is at a high frequency, further, movement of the chip-type electronic components 9 cannot follow that of the cathode 4 and the contact time of the chip-type electronic components 9 and the cathode 4 is so extremely reduced that the plating speed is remarkably reduced.

SUMMARY OF THE INVENTION

An object of the present invention is to provide a plating apparatus for plating objects by placing the same on a cathode and vibrating this cathode, which can reliably prevent undesired adhesion between the objects themselves and between the objects and the cathode, for reliably forming plating layers on the objects in a short time.

A plating apparatus according to the present invention comprises a plating solution container storing a plating solution, and a cathode, dipped in the plating solution, which is so formed as to receive objects thereon. This cathode is formed by a mesh member or a porous plate, thereby smoothly supplying the plating solution in the vicinity of the objects.

According to the present invention, vibration means is coupled to the cathode, in order to apply vibration to the cathode for horizontally reciprocating the same. The vibration means can be prepared from arbitrary means such as a reciprocatory driving source such as an air cylinder or an oil-hydraulic cylinder, or means which is formed by combining a rotary driving source such as a motor with a rack and a pinion or a cam, for example, so far as the same can horizontally reciprocate the cathode.

The plating apparatus further comprises a stopper for colliding with a movable part of the vibration means or the cathode during the reciprocation stroke therefor. This stopper is so positioned as to collide with the movable part of the vibration means or the cathode, thereby inverting the objects which are placed on the cathode by an impact resulting from the collision.

The stopper may be fixedly provided to collide with the movable part or the cathode every reciprocation stroke, or the position thereof may alternatively be rendered changeable to collide with the movable part of the vibration means or the cathode in at least two cycles of the vibration means.

When the objects are prepared from chip-type electronic components so that plating layers are formed on external electrodes thereof, the cycle of the vibration means is set in the range of 0.05 to 10 seconds. If the cycle is less than 0.05 seconds, the vibration frequency is so excessively increased that the contact time between the chip-type electronic components and the cathode is reduced to reduce the plating speed. If the cycle exceeds 10 seconds, on the other hand, the contact time between the chip-type electronic components and the cathode is excessively increased to result in undesired adhesion therebetween.

In the plating apparatus according to the present invention, the objects are placed on the cathode, which in turn is vibrated by vibration applied by the vibration means. Therefore, relative movement of the cathode and the objects is caused by the vibration. Further, the movable part of the vibration means or the cathode collides with the stopper for inverting or rolling the objects on the cathode, thereby preventing the objects from adhering to each other and to the cathode.

When the stopper is so fixed as to collide with the cathode or the movable part of the vibration means every reciprocation of the cathode, the objects are inverted or rolled every reciprocation cycle. Thus, it is possible to further effectively prevent adhesion between the objects and the cathode as well as between the objects themselves.

Thus, it is possible to reliably form plating films of desired thicknesses on necessary portions of the objects at a high speed.

As compared with the conventional barrel plating apparatus, the cost for plating can be reduced due to no requirement for media such as steel balls.

When the position of the stopper is rendered changeable so that the same collides with the movable part of the vibration means or the cathode in at least two cycles of the vibration means, it is possible to plate the objects while adjusting formation of plating layers on the objects and the effect of preventing the objects from adhering to each other and to the cathode.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

An embodiment of the present invention is now described with reference to the drawings, thereby clarifying the present invention.

Figure 1:
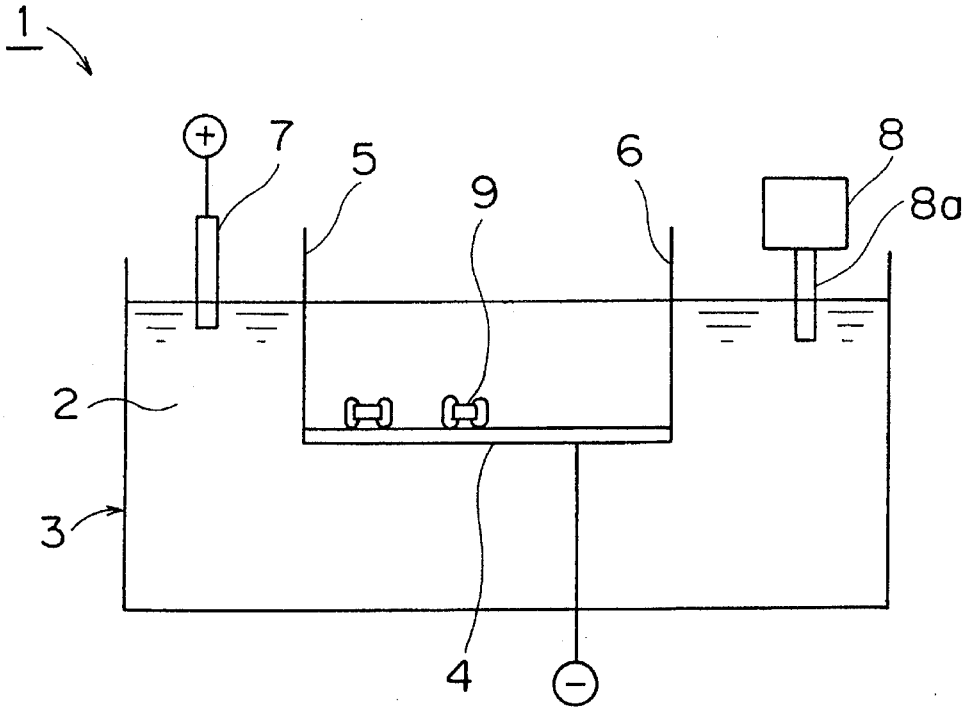
FIG. 1 PRIOR ART
FIG. 1 is a schematic block diagram for illustrating an exemplary conventional plating apparatus.
Figure 2:
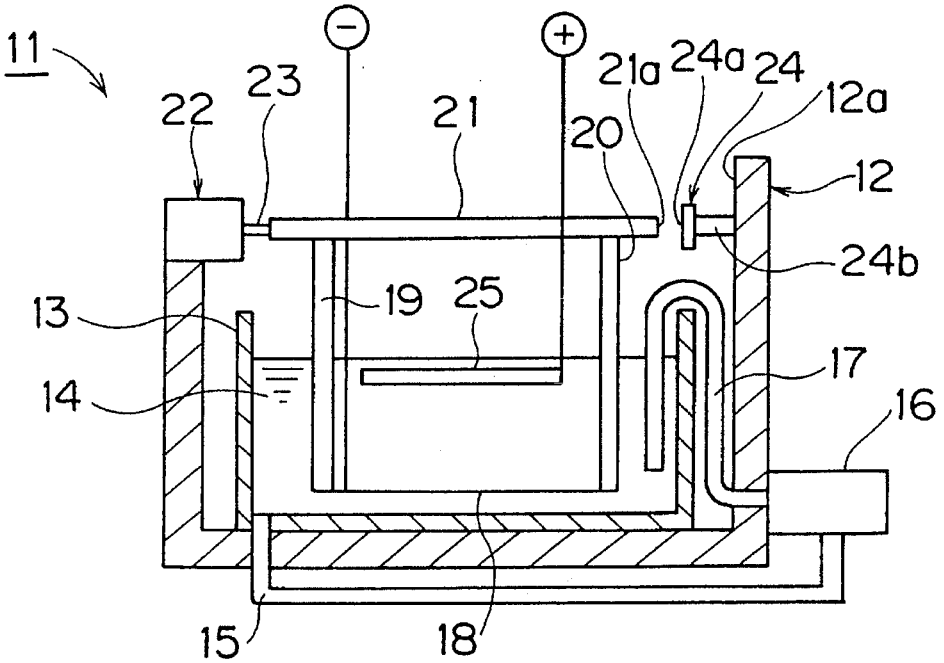
FIG. 2 is a sectional view showing a plating apparatus according to an embodiment of the present invention.

FIG. 2 is a sectional view showing a plating apparatus 11 according to the embodiment of the present invention.

The plating apparatus 11 is formed by a frame body 12 having an opening 12*a* in its upper portion. A plating solution container 13 is arranged in the frame body 12. This plating solution container 13 stores a plating solution 14 for wet plating. A conduit 15 for circulating the plating solution 14 is mounted to pass through bottom plates of the plating solution container 13 and the frame body 12.

The conduit 15 is coupled to a pump 16. Another conduit 17 is also coupled to the pump 16, so that its forward end extends in the plating solution 14. When the pump 16 is driven, therefore, the plating solution 14 is circulated in the plating solution container 13.

On the other hand, a cathode 18 is dipped in the plating solution container 13. According to this embodiment, the cathode 18 is formed by a metal mesh member. Objects formed by a number of chip-type electronic components (not shown) are placed on the cathode 18.

The cathode 18 is fixed to lower ends of support members 19 and 20 consisting of an insulating material, which are provided on both ends. Upper ends of the support members 19 and 20 are fixed to a coupling member 21. This coupling member 21 is fixed to a forward end of a cylinder rod 23 of an air cylinder 22. When the air cylinder 22 is driven, therefore, the coupling member 21 is transversely reciprocated in FIG. 2. Following this reciprocation of the coupling member 21, the cathode 18 is also transversely reciprocated.

A stopper 24 is provided in front of the forward end of the coupling member 21. This stopper 24 has a plate 24*a* and a support part 24*b*, which is coupled to the plate 24*a* and fixed to an inner wall of the frame body 12. The plate 24*a* of the stopper 24 is so positioned that the forward end 21*a* of the coupling member 21 collides with the plate 24*a* during the reciprocation stroke when the air cylinder 22 is driven.

An anode 25 is also dipped in the plating solution 14. In the plating apparatus 11 according to this embodiment, a voltage is applied across the anode 25 and the cathode 18, thereby forming plating films on external electrodes of the chip-type electronic components which are placed on the cathode 18, by electroplating.

In this plating operation, the air cylinder 22 is driven to transversely reciprocate the cathode 18. Thus, the chip-type electronic components are transversely slid on the cathode 18.

In the plating apparatus 11 according to this embodiment, the movement of the cathode 18 is controlled by the stopper 24. Namely, the forward end 21*a* of the coupling member 21 collides with the plate 24*a*, thereby stopping the movement of the cathode 18 during the reciprocation stroke. Due to an impact resulting from the collision, the chip-type electronic components which are placed on the cathode 18 are inverted or rolled. Thus, it is possible to effectively prevent the chip-type electronic components from adhering to themselves and to the cathode 18.

Description is now made on concrete experimental example which was made through the plating apparatus 11 according to the embodiment shown in FIG. 2.

Objects were prepared from chip-type multilayer capacitors having outer dimensions of 3.2 by 1.6 mm and thicknesses of 1 mm. Ni was plated on external electrodes of the multilayer capacitors.

The plating solution 14 was prepared from a watt bath, whose temperature was set at 40° C. A current of 20 A per 10 $cm^2$ was fed across the cathode 18 and the anode 25, for carrying out plating. The cathode 18 was prepared from a metal mesh member of 30 meshes having a plane shape of 150 by 150 mm.

The stroke of reciprocation caused by the air cylinder 22 for plating was adjusted to vary the cycle in the range of 0.05 to 10 seconds. The moving stroke of the air cylinder 22 was 20 mm, and the position of the stopper 24 was changed to vary the amount of maximum movement of the coupling member 21, i.e., the cathode 18, in the range of 0.5 to 20 mm.

Under the aforementioned conditions, plating was carried out for 10 minutes on the objects, for evaluating mean values X of thicknesses of the obtained plating layers and dispersion $\sigma/x$ of the thicknesses of the plating layers. Table 1 shows the results.

Referring to Table 1, ○ shows samples having mean values of plating layer thicknesses of at least 1.0 μm and dispersion of film thicknesses of not more than 0.3, and X shows samples not satisfying the aforementioned conditions.

TABLE 1

| | Values of Plating Layer Thicknesses X (μm) | Dispersion of Film Thicknesses δ/X | Conditions: Vibration Cycle (sec.) | Conditions: Amplitude Range (mm) | Result |
|---|---|---|---|---|---|
| Example 1 | 0.8 | 0.1 | 0.01 | 0.5 | X |
| Example 2 | 1.0 | 0.1 | 0.05 | 0.5 | ○ |
| Example 3 | 1.5 | 0.2 | 0.2 | 0.5 | ○ |
| Example 4 | 6 | 0.3 | 3 | 0.5 | ○ |
| Example 5 | 10 | 0.4 | 5 | 0.5 | X |
| Example 6 | 6 | 0.2 | 3 | 20 | ○ |
| Comparative Example (barrel plating) | 1.0 | 0.3 | — | — | — |

1000 multilayer capacitors were plated in the aforementioned manner, whereby it was confirmed possible to reliably form plating layers on external electrodes through the plating apparatus 11 according to this embodiment, with no adhesion between the multilayer capacitors and between the same and the cathode 18. This is conceivably because the multilayer capacitors were inverted or rolled on the cathode 18 due to collision of the forward end 21*a* of the coupling member 21 with the stopper 24.

As clearly understood from Table 1, it was impossible to obtain plating layers of sufficient thicknesses at the vibration cycle of 0.01 seconds conceivably because the plating speed was retarded. Sufficient film thicknesses were obtained when the vibration cycles were in excess of 0.05 seconds, while dispersion of film thicknesses was at a considerably large value of 0.4 at the cycle of 5 seconds. Thus, it is understood that the vibration cycle may be selected in the range of 0.05 to 3 seconds, in order to form plating layers of desired thicknesses with no dispersion on the chip-type electronic components.

As to the amplitude, it is clearly understood from Table 1 that plating layers of desired film thicknesses can be formed with no dispersion in the amplitude range of 0.5 to 20 mm by selecting the vibration cycle in the aforementioned range.

The results shown in Table 1 were obtained with reference to Ni plating layers which were formed on the external electrodes of the aforementioned chip-type multilayer capacitors. The conditions for the cycle and the amplitude of the vibration cannot be univocally determined since the same may be varied with the dimensions of the objects, the composition of the plating solution, the value of the current which is fed for plating, and the like.

While the stopper 24 is arranged to collide with the forward end 21*a* of the coupling member 21 in the aforementioned embodiment, the same may alternatively be arranged to collide with the cathode 18 or the support members 19 and 20. In other words, the stopper 24 may be arranged to collide with either a movable part of vibration means or the cathode 18.

While the position of the stopper 24 is so fixed that an impact is applied by the stopper 24 every reciprocation of the cathode 18 in this embodiment, the position of the stopper 24 may alternatively be rendered variable so that the movable part of the vibration means or the cathode 18 intermittently collides with the stopper 24.

Figure 3:
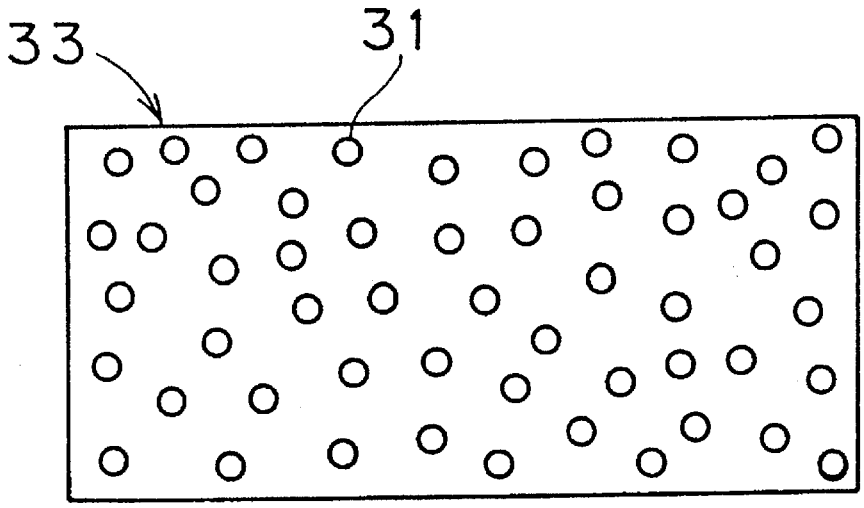
FIG. 3 is a plan view showing another example of a cathode.

While the cathode 18 is formed by a metal mesh member in this embodiment, further, the same may alternatively be formed by a porous plate 33 having a number of through holes 31, as shown in FIG. 3. In place of the metal mesh member or the porous plate consisting of a metal, further, the cathode may be formed by a mesh member consisting of an insulating material or a member prepared by treating a surface of a porous plate with a conductive material.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A plating apparatus comprising:

a plating solution container for storing a plating solution; and a cathode, arranged for dipping into said plating solution, being so formed as to receive objects thereon, said cathode being formed by a mesh member or a porous plate, said plating apparatus further comprising:

vibration means being coupled to said cathode for applying vibration for horizontally reciprocating said cathode; and a stopper being so provided as to collide with a movable part of said vibration means or said cathode during the reciprocation stroke for said movable part of said vibration means or said cathode.

2. The plating apparatus in accordance with claim 1, wherein said stopper is so fixed as to collide with said movable part of said vibration means or said cathode every reciprocation of said cathode.

3. The plating apparatus in accordance with claim 1, wherein said stopper is rendered changeable in position to collide with said movable part of said vibration means or said cathode in at least two cycles of said vibration means.

4. The plating apparatus in accordance with claim 1, wherein the cycle of said vibration is set in the range of 0.05 to 10 seconds.

5. The plating apparatus in accordance with claim 1, wherein said vibration means is provided with an air cylinder having a cylinder rod being reciprocated by an air pressure and a coupling member being coupled to said cylinder rod.

6. The plating apparatus in accordance with claim 1, wherein said cathode is formed by a metal mesh member.

7. The plating apparatus in accordance with claim 1, wherein said stopper has a plate and a support part being coupled to said plate, said support part being fixedly provided on said plating apparatus.

* * * * *